US005261825A

United States Patent [19]

Chaves

[11] Patent Number: 5,261,825

[45] Date of Patent: Nov. 16, 1993

[54] ELECTRICAL SAFETY RECEPTACLE

[76] Inventor: John S. Chaves, 43 Balsam St., Fairhaven, Mass. 02719

[21] Appl. No.: 961,665

[22] Filed: Oct. 16, 1992

[51] Int. Cl.[5] ..... H01R 29/00; H01R 19/40; H01R 33/96

[52] U.S. Cl. ..... 439/52; 439/535; 200/51.11; 200/51.12

[58] Field of Search ..... 439/188, 172, 650, 535, 439/536, 924, 52; 174/66, 67; 200/51.11, 51.12, 51.03, 51.05, 50 B

[56] References Cited

U.S. PATENT DOCUMENTS 3,942,856 3/1976 Minheim et al. ..... 439/188
4,484,185 11/1984 Graves ..... 439/135
5,071,360 12/1991 Lindow et al. ..... 439/188

FOREIGN PATENT DOCUMENTS 2239742 7/1991 United Kingdom ..... 439/188

*Primary Examiner*—P. W. Echols

*Assistant Examiner*—David P. Bryant

*Attorney, Agent, or Firm*—S. Michael Bender

[57] ABSTRACT

An electrical outlet receptacle adapted to be plugged into a conventional wall socket includes a circuit interrupting switch in the form of a bar or rod axially extending from the receptacle housing and being movable between first and second positions. The receptacle includes a pair of blade contacts engageable with the receptacle of a wall socket which blade contacts have a gap situated therein in such a manner as to orthogonally engage in a slidable fashion the axially movable bar. The latter, in turn, carries a pair of contacts adapted to bridge the gap in the switch blades depending upon the axial position of the bar. Thus, in the first position of the bar, the contacts do not bridge the gaps in the blade contacts whereas in the second position of the bar the contacts do bridge the gaps in the blade contacts thereby permitting an appliance plugged into the safety receptacle to draw electrical power from the wall socket.

5 Claims, 4 Drawing Sheets

ELECTRICAL SAFETY RECEPTACLE

BACKGROUND OF THE INVENTION

1. Field of the Invention

The present invention relates generally to electrical switches, and more particularly, to an electrical safety receptacle adapted to be plugged into a conventional electrical wall socket outlet or the like.

2. Description of the Prior Art

Switches for enabling and/or disabling an electrical wall outlet generally are well known. For example, in U.S. Pat. No. 4,080,518 there is disclosed a wall mountable receptacle having an integral rocker switch and associated mechanism for selectively turning the receptacle power on or off as desired. Similarly, U.S. Pat. No. 3,846,598 discloses a wall mounted receptacle including internal switch means activatable by insertion of the grounding prong on the plug of the appliance electrical cord being plugged into the receptacle. Frequently, it is desirable to convert a conventional non-switchable wall socket or outlet receptacle into one which is capable of being selectively switched on or off without manipulating the power cord plugged into the receptacle of a wall socket. For example, when using conventional electrical wall outlets, it is common to merely plug or unplug the power cord to control the flow of electrical power to an appliance. Such practice can be dangerous because insertion and/or withdrawal of a power cord from a wall socket without first opening the circuit to the appliance may result in sparking, or even electrical shock. A need exists therefore, for a safe receptacle unit which may be permanently plugged into a convention wall socket and which includes switch means activatable to control the flow of electrical power through the wall socket thereby obviating the plugging in or withdrawal of an electrical plug of an appliance which may be in a closed circuit or "hot" condition.

The foregoing advantages are accomplished by the unique electrical safety receptacle of the present invention as will be made apparent from the following description thereof. Other advantages of the present invention over the prior art also will be rendered evident.

SUMMARY OF THE INVENTION

To achieve the foregoing and other advantages, the present invention, briefly described, provides an electrical safety receptacle adapted to be plugged into a conventional wall socket including a circuit interrupting switch in the form of a bar or rod axially extending from the receptacle housing and being movable between first and second positions. The receptacle includes a pair of blade contacts engageable with the receptacle of a wall socket which blade contacts have a gap situated therein in such a manner as to orthogonally engage in a slidable fashion the axially movable bar. The latter, in turn, carries a pair of contacts adapted to bridge the gap in the switch blades depending upon the axial position of the bar. Thus, in the first position of the bar, the contacts do not bridge the gaps in the blade contacts whereas in the second position of the bar the contacts do bridge the gaps in the blade contacts thereby permitting an appliance plugged into the safety receptacle to draw electrical power from the wall socket.

The above brief description sets forth rather broadly the more important features of the present invention in order that the detailed description thereof that follows may be better understood, and in order that the present contributions to the art may be better appreciated. There are, of course, additional features of the invention that will be described hereinafter and which will form the subject matter of the claims appended hereto.

In this respect, before explaining at least two preferred embodiments of the invention in detail, it is to be understood that the invention is not limited in its application to the details of the construction and to the arrangements of the components set forth in the following description or illustrated in the drawings. The invention is capable of other embodiments and of being practiced and carried out in various ways. Also, it is to be understood, that the phraseology and terminology employed herein are for the purpose of description and should not be regarded as limiting.

As such, those skilled in the art will appreciate that the conception, upon which this disclosure is based, may readily be utilized as a basis for designing other structures, methods, and systems for carrying out the several purposes of the present invention. It is important, therefore, that the claims be regarded as including such equivalent constructions insofar as they do not depart from the spirit and scope of the present invention.

Further, the purpose of the foregoing Abstract is to enable the U.S. Pat. and Trademark Office and the public generally, and especially the scientists, engineers and practitioners in the art who are not familiar with patent or legal terms of phraseology, to determine quickly from a cursory inspection the nature and essence of the technical disclosure of the application. Accordingly, the Abstract is neither intended to define the invention or the application, which only is measured by the claims, nor is it intended to be limiting as to the scope of the invention in any way.

It is therefore an object of the present invention to provide a new and improved electrical safety receptacle which has all of the advantages of the prior art and none of the disadvantages.

It is another object of the present invention to provide a new and improved electrical safety receptacle which may be easily and efficiently manufactured and marketed.

It is further objective of the present invention to provide a new and improved electrical safety receptacle which is of durable and reliable construction.

Still yet a further object of the present invention is to provide a new and improved electrical safety receptacle capable of being plugged into a conventional wall socket and which includes safety switch means for selectively shutting off or turning on the flow of electrical power through the receptacle.

These together with still other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there are illustrated preferred embodiments of the invention.

BRIEF DESCRIPTION OF THE DRAWINGS

The invention will be better understood and the above objects as well as objects other than those set forth above will become more apparent after a study of the following detailed description thereof. Such description makes reference to the annexed drawings wherein.

DESCRIPTION OF THE PREFERRED EMBODIMENT

Figure 1:
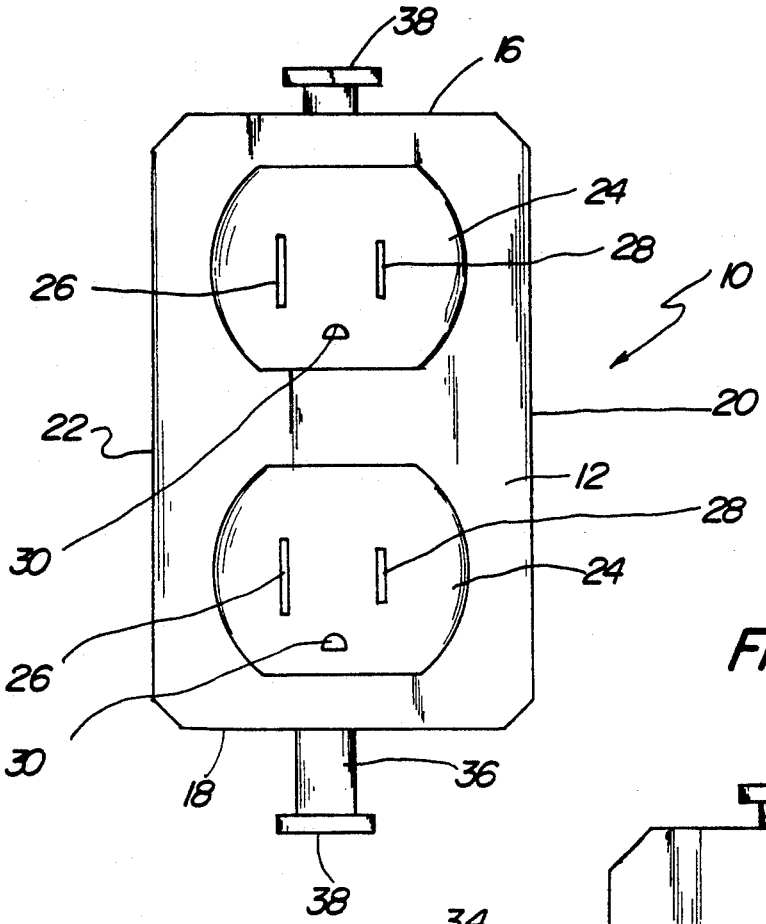
FIG. 1 is an elevational front view of the first preferred embodiment of the electrical safety receptacle of the invention.
Figure 2:
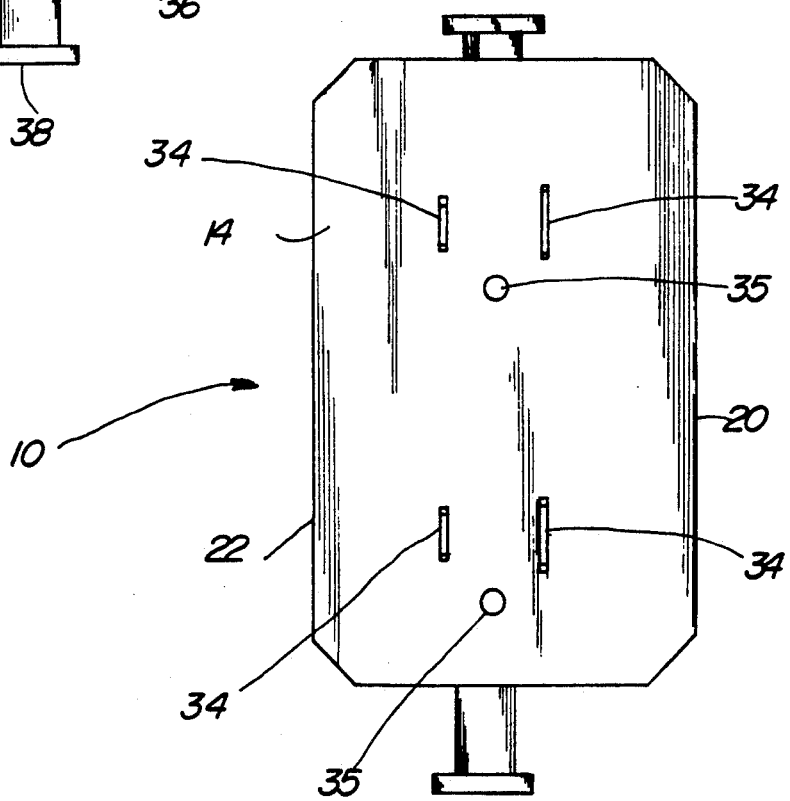
FIG. 2 is an elevational rear view of the first preferred embodiment of the electrical safety receptacle of the invention.

With reference now to the drawings, a new and improved electrical safety receptacle embodying the principles and concepts of the present invention will be described.

Turning initially to FIGS. 1-4, there is shown a first exemplary embodiment of the electrical safety receptacle designated by reference numeral 10. In its preferred form, electrical safety receptacle 10 comprises generally a rectangularly shaped housing having front and rear opposed walls 12, 14; top and bottom opposed walls 16, 18; and right and left opposed sides 20, 22. The housing serves as an enclosure for a pair of conventional electrical contact receptacles each designated generally by reference numeral 24 and each of which extends through a suitably sized and shaped opening in front wall 12 substantially as shown. Such electrical contact receptacles are well known and the details of same form no part of the present invention. Each receptacle, in turn, has suitable openings 26, 28 to receive the blade contacts or prongs (not shown) of a conventional electrical plug such as is commonly employed to draw electrical current from a wall socket rated nominally at 120 volts, for example. In addition, each receptacle 24 has a suitable opening 30 for the ground prong (also not shown) of the electrical plug adapted to be inserted in receptacle 24.

Figure 4:
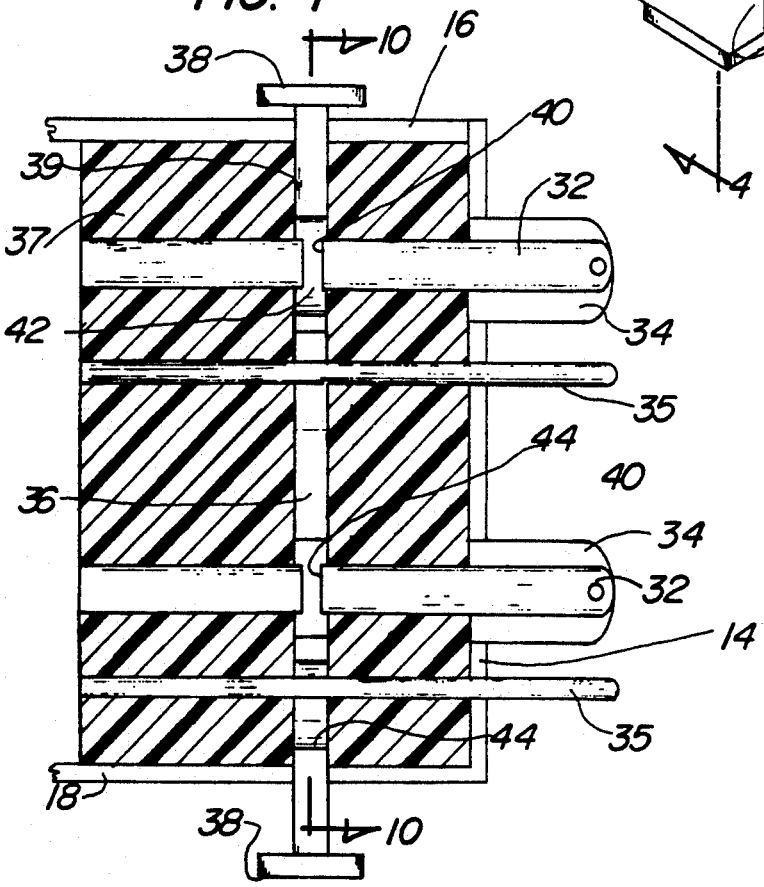
FIG. 4 is a cross-sectional view taken along line 4—4 of FIG. 3.

In accordance with the invention, the individual contacts disposed respectively in openings 26, 28 and 30 are suitably electrically connected by soldering a corresponding conductor, for example, to one end of corresponding blade contacts 32, 34 and 35, each axially supported within a block of molded electrically insulative material 37 suitably supported interiorly of the housing between receptacles 24 and rear wall 14 (See FIG. 4). The other opposite ends of blade contacts 32, 34 and 35 extend axially through suitable recesses therefor provided in rear wall 14 so that the receptacle 10 may, in turn, be plugged into a conventional wall-mounted electrical socket or outlet receptacle in a manner believed apparent from the above description. It will be appreciated that receptacle 10 is portable and may be moved from one wall outlet or electrical socket to another, either indoors or out.

A transverse slot 39 extends from top wall 16 through the insulative block 37 and opens into and through bottom wall 18 and provides a passage for slidable contact bar 36 which latter is adapted to slide up and down in passage or slot 39 between a first "contact making" position and a second "contact breaking" position via the aid of corresponding finger tabs 38 as will be more fully explained.

Figure 3:
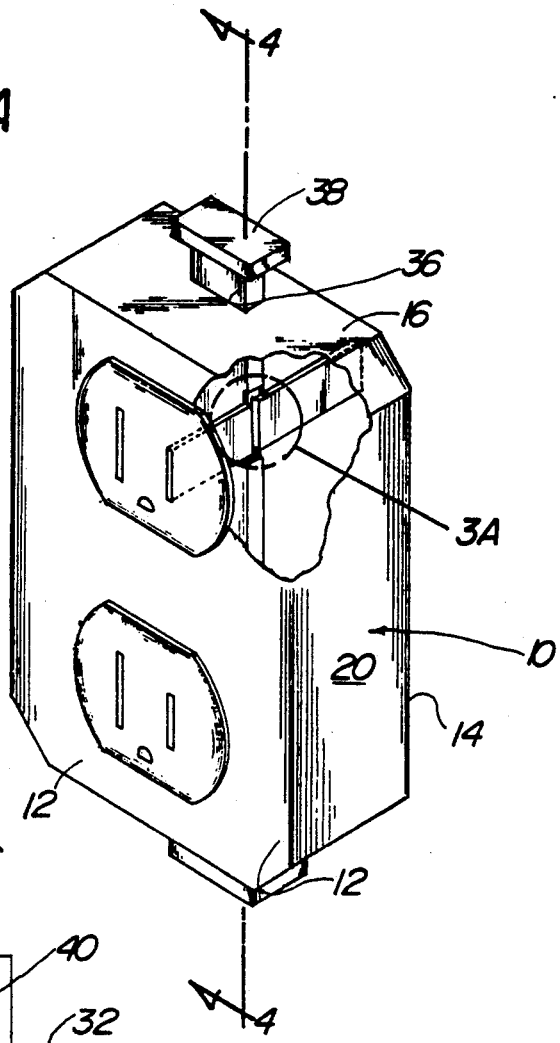
FIG. 3 is a perspective elevational view of the embodiment of the electrical safety receptacle of the invention shown in FIGS. 1 and 2.
Figure 3A:
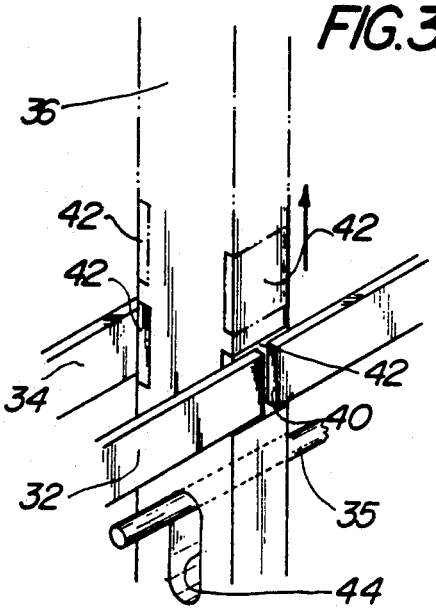
FIG. 3A is detail in perspective of a portion of the invention shown in FIG. 3.

Contact bar 36 also is fabricated of electrically insulative material, but according to the invention has a pair of opposed electrically conductive bridging contacts each designated by reference numeral 42 suitably embedded therein as best viewed in FIG. 3A. In addition, each blade contact 32, 34 has a gap or circuit break 40 axially located therein, but which gap is adapted to be bridged in an electrically conducting manner by a corresponding bridging contact 42 if and when slide bar 36 is in its first "contact making" position as shown by the solid lines in FIG. 3A. In order to limit the slidable movement of bar 36 in its passage 39 and define the first and second operating switch positions thereof, a pair of identical oblong transverse through slots 44 are provided in the slide bar in general axial alignment with ground conductors 35, respectively, and are suitably sized, shaped and positioned as substantially shown to engage conductor 35 at its top-most extremity when bar 36 is in the position shown in FIG. 3A. It will be observed that in this position, contact 42 makes bridging contacting engagement across the gap 40 in each blade conductor 32, 34 and thus, defines the first "contact making" position of the switch bar 36.

It will be observed further that when slidable switch bar 36 is displaced or moved upwardly to a position where contacts 42 are no longer in bridging contact across the gap in blade contacts 32, 34 (i.e. the position indicated by broken lines in FIG. 3A), the conductors 35 will engage the bottom of each oblong transverse slot 44 as viewed in FIG. 3A thus defining the second or "contact breaking" position of the switch bar 36. Alternatively, the limits of movement of switch bar 36 between its first and second operating positions may be determined by suitable detents between block 37 and slidable switch bar 36 as will occur to those of ordinary skill in which case oblong recess 44 are configured merely to allow for up and down movement of the switch bar between a "make" and a "break" condition while avoiding interference with the ground conductors 35.

In operation, the receptacle 10 is plugged into a conventional wall socket and the plug to an appliance to be electrically powered is then plugged into the receptacle 10. A user may then activate slidable switch bar 36 by moving it up or down between its "make" or "break" positions to control the flow of electricity to the appliance without the necessity of frequently plugging the appliance cord into a wall socket or pulling it from same, i.e. the appliance may be left safely in a plugged in condition.

Figure 5:
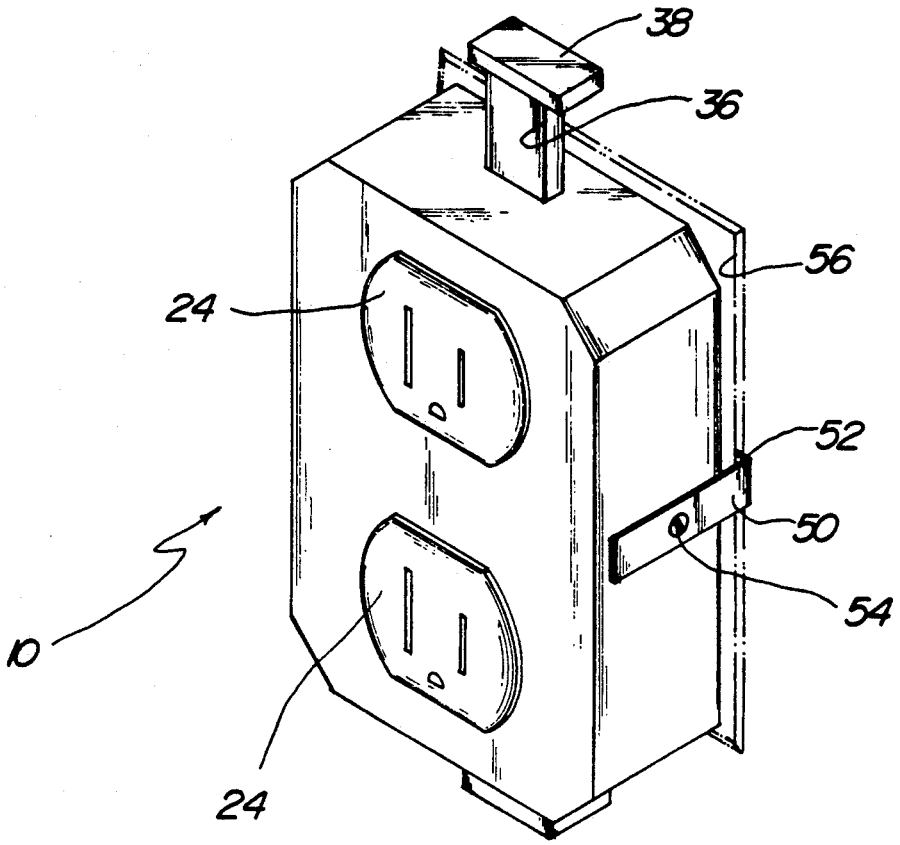
FIG. 5 is an elevational view in perspective of an alternatively preferred embodiment of the electrical safety receptacle of the invention.

Turning now to FIG. 5, there is shown a slightly modified version of the preferred form of the invention wherein a bracket 50 having an integral right angle lip or hook section 52 is employed substantially as shown to form a more stable connection between the receptacle 10 and the cover plate 56 of a conventional wall socket outlet or receptacle to which the safety receptacle of the invention is plugged into. A suitable male fastener 54 preferably is used to anchor the bracket 50 to each sidewall 20, 22 of the receptacle 10. This arrangement helps to maintain the receptacle 10 in its intended plugged-in condition with respect to the wall socket with which it is to be used.

Figure 6:
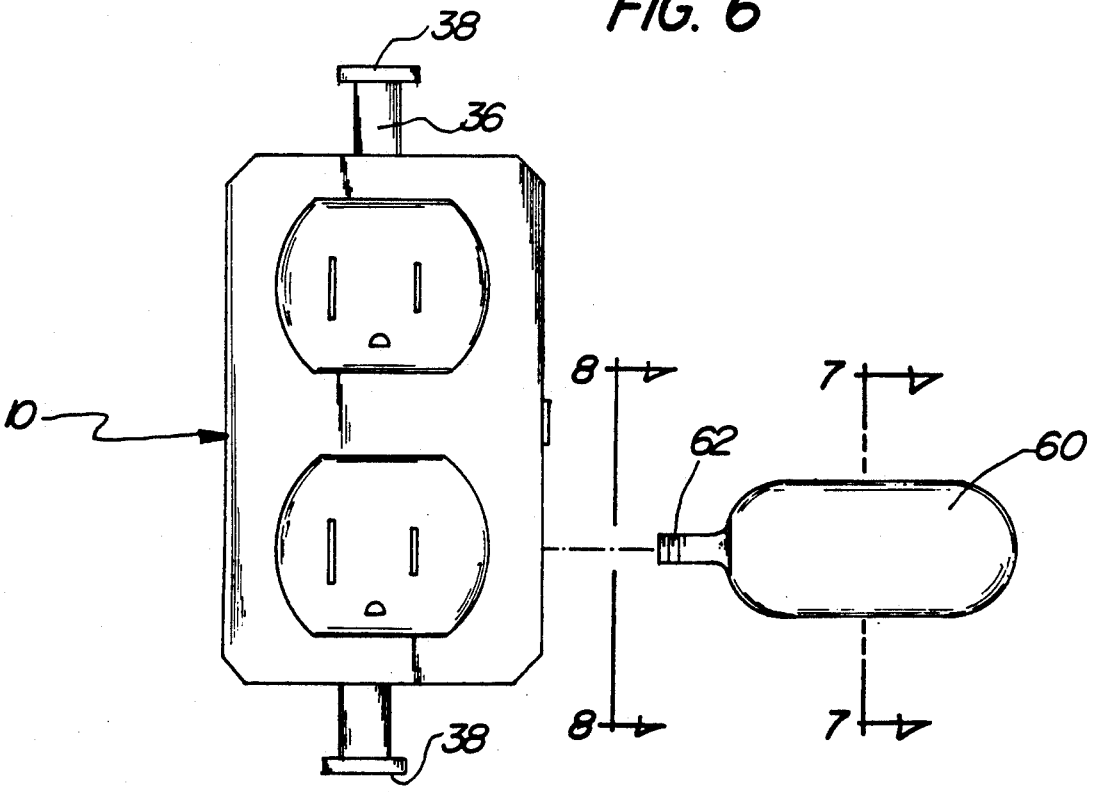
FIG. 6 is an elevational front view of yet another alternatively preferred embodiment of the electrical safety receptacle of the invention.
Figure 7:
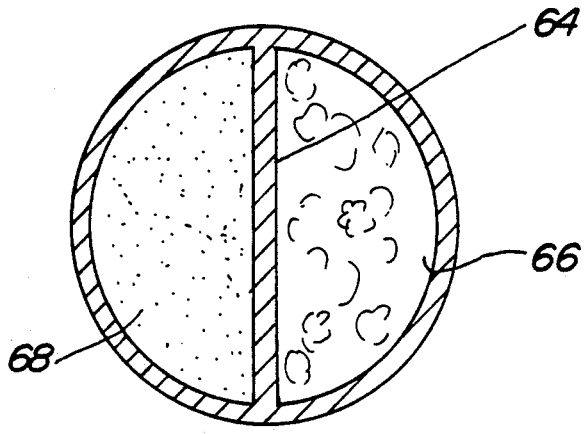
FIG. 7 is a cross-sectional view taken along line 7—7 of FIG. 6.
Figure 8:
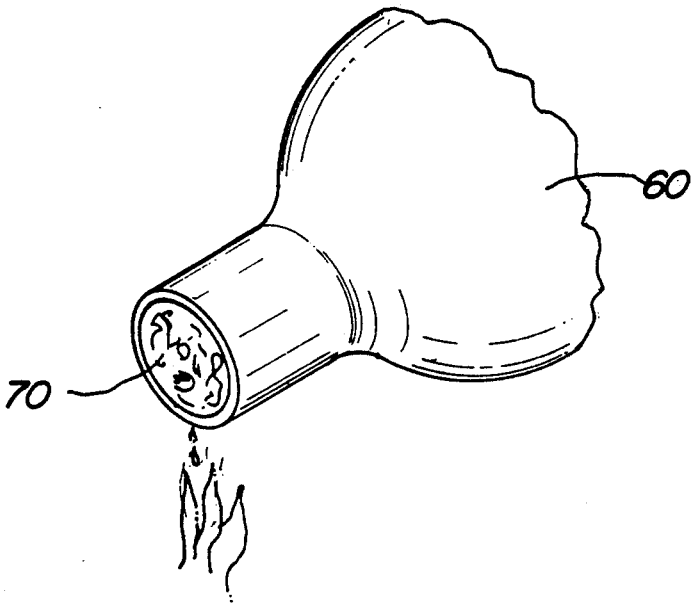
FIG. 8 is a perspective view of a portion of the alternatively preferred embodiment of FIG. 6 taken along line 8—8 thereof.

Finally, there is shown in FIGS. 6, 7 and 8 a still further modified version of the preferred exemplary embodiment of the invention including a cartridge 60 adapted to be threadedly engaged with the interior of receptacle 10 through a suitable opening (not shown) in the sidewalls 20 or 22. Cartridge 60 has a partition 64 to divide the interior portion thereof into two chambers, one of which includes a colored smoke compound under pressure, and the other of which includes an aerosol under pressure of a conventional powdered fire retardant compound. The neck of cartridge 60 has a wax seal 70 which is meltable in the presence of fire or excessive heat. Hence, in the event a short circuit condition causes a fire in or around receptacle 10, the wax seal will melt thereby releasing the colored smoke and fire retardant stored in cartridge 60.

It is apparent from the above that the present invention accomplishes all of the objectives set forth by providing a new and improved electrical safety receptacle that is low in cost, relatively simple in design and operation, and which may advantageously be used by being plugged into a conventional wall socket and which includes safety switch means for selectively shutting off or turning on the flow of electrical power through the receptacle.

With respect to the above description, it should be realized that the optimum dimensional relationships for the parts of the invention, to include variations in size, materials, shape, form, function and manner of operation, assembly and use, are deemed readily apparent and obvious to those skilled in the art, and therefore, all relationships equivalent to those illustrated in the drawings and described in the specification are intended to be encompassed only by the scope of appended claims.

While the present invention has been shown in the drawings and fully described above with particularity and detail in connection with what is presently deemed to be the most practical and preferred embodiment(s) of the invention, it will be apparent to those of ordinary skill in the art that many modifications thereof may be made without departing from the principles and concepts set forth herein. Hence, the proper scope of the present invention should be determined only by the broadest interpretation of the appended claims so as to include such modifications and/or alterations.

What is claimed as being new and desired to be protected by Letters Patent of the United States is as follows:

1. A new and improved electrical safety receptacle adapted to be plugged into a conventional wall socket comprising:

a housing, said housing having at least one electrical receptacle contact assembly, and conductive blade means, one end of said conductive blade means being connected to said electrical contact assembly interiorly of said housing and the other end of said conductive blade means extending from said housing for being plugged into said conventional wall socket, circuit switch means associated with said housing being activatable between first and second positions, and wherein said conductive blade means has a circuit braking gap disposed therein within said interior of said housing, said circuit switch means adapted to make bridging contact across said gap thereby to establish an electrical circuit between said receptacle contact assembly and said extending end of said conductive blade means in said first position, and to avoid bridging contact across said gap in said second position, wherein said circuit switch means comprises a passage in said housing, slidable bar means disposed in said passage, and bridging contact means affixed to said bar means, said passage and said bar means extending orthogonally with respect to said conductive blade means such that movement of said bar means in said passage from said second position to said first position is adapted to cause said bridging contact means to engage said conductive blade means across said gap therein and whereas movement of said bar means in said passage from said first position to said second position is adapted to cause said bridging contact means to avoid engaging said conductive blade means in the vicinity of said gap therein, and wherein said conductive blade means comprises a pair of spaced parallel blade contacts and a ground conductor, and said bar means includes an oblong opening therein through which said ground conductor extends whereby said bar means is displaceable between said first and second switch positions without interfering with said ground conductor.

2. The invention of claim 1 wherein said bar means has a pair of opposed ends and said opposed ends extend respectively from opposite ends of said housing.

3. The invention of claim 2 wherein said bar means passage extends between said pair of spaced blade contacts, and said bridging contact means comprises a pair of electrically conductive contacts disposed on opposite sides of said bar means whereby said contacts are adapted to slidably engage said blade contacts in the vicinity of said gaps therein.

4. The invention of claim 3 further including bracket means adapted to maintain said receptacle plugged into said wall socket.

5. The invention of claim 3 further including cartridge means attached to said housing and having an opening communicating with the interior of said housing, said cartridge having a heat meltable seal, said cartridge further including a fire retardant compound and a colored smoke compound in separate compartments thereof.

* * * * *